US005356010A

United States Patent [19]

Weinstein

[11] Patent Number: 5,356,010

[45] Date of Patent: Oct. 18, 1994

[54] CONTAINER WITH BLISTER PACK OPENER

[75] Inventor: Jack Weinstein, Manchester Township, Ocean County, N.J.

[73] Assignee: Primary Delivery Systems, Inc., Easton, Pa.

[21] Appl. No.: 6,528

[22] Filed: Jan. 21, 1993

[51] Int. Cl.[5] ..... B65D 83/04

[52] U.S. Cl. ..... 206/532; 206/528; 229/103

[58] Field of Search ..... 206/528, 531, 532, 535, 206/539; 229/229, 162, 103; 225/103, 93; 30/124; 220/284

[56] References Cited

U.S. PATENT DOCUMENTS

| | | | |
|---|---|---|---|
| 2,386,416 | 10/1945 | Wilhelm | 206/532 X |
| 2,473,492 | 6/1949 | Shina | 229/229 |
| 2,497,455 | 2/1950 | Johnson | 206/531 X |
| 3,721,382 | 3/1973 | Cavanaugh | 229/229 X |
| 3,993,190 | 11/1976 | Schmidgall | 206/531 X |
| 4,015,717 | 4/1977 | Richardson et al. | 206/531 X |
| 4,126,263 | 11/1978 | Martensson | 229/229 |
| 4,144,985 | 3/1979 | Kinslow | 220/339 X |
| 4,159,568 | 7/1979 | Berner | 206/528 X |
| 4,179,806 | 12/1979 | Lieptz | 206/528 X |
| 4,384,649 | 5/1983 | Brodsky . | |
| 4,457,427 | 7/1984 | Cafiero | 206/531 X |
| 4,706,875 | 11/1987 | Blackman | 229/229 |
| 4,778,054 | 10/1988 | Newell et al. . | |
| 4,887,755 | 12/1989 | Gibilisco | 225/103 |
| 4,905,866 | 3/1990 | Bartell et al. | 206/531 X |
| 4,909,395 | 3/1990 | Weissman | 229/229 X |
| 5,019,125 | 5/1991 | Rebne et al. . | |
| 5,109,984 | 5/1992 | Romick . | |
| 5,118,021 | 6/1992 | Fiocchi | 225/103 |

FOREIGN PATENT DOCUMENTS

| | | | |
|---|---|---|---|
| 2822100 | 11/1979 | Fed. Rep. of Germany | 206/531 |
| 0467606 | 6/1937 | United Kingdom | 206/531 |

*Primary Examiner*—Paul T. Sewell
*Assistant Examiner*—Ted Kavanaugh
*Attorney, Agent, or Firm*—Kenneth P. Glynn

[57] ABSTRACT

The present invention is a medication container which includes a package designed to receive a softpack of individually segregated unit dosages of medication and a softpack puncturing mechanism located on a flat surface of the package. The softpack puncturing mechanism has a base segment and a top segment hingedly connected to one another. The base segment has an orifice located thereon which is of sufficient size to receive a unit dosage section of a softpack and the top segment has a protrusion adapted to nest within the orifice of the bottom segment. The protrusion of the top segment has sufficient height so as to puncture a dosage unit section of a softpack of medication.

16 Claims, 2 Drawing Sheets

CONTAINER WITH BLISTER PACK OPENER

BACKGROUND OF THE INVENTION

1. Field of the Invention

The present invention is directed to soft-pack medication accessing, and more particularly, is directed to packaging which enables a user to at least partially open a softpack of medication. By softpack is meant a plastic and/or foil or other "push the pill or capsule out" type of medication inner package commonly known as "blisterpacks". Thus, the present invention is directed to a container for softpacks of medication with individual dosage opening capabilities.

2. Information Disclosure Statement

Various inner packaging of medications have evolved over the past couple of decades which involves individual dosages arranged so as to be separated from one another within a blisterpack, a paperpack, a metal/foil ! pack or a pack which uses a combination of materials. These may enclose powder, pills, capsules or even liquid caps or other medication dosage collections. Thus, while the application herein refers to "softpacks" or "blisterpacks" such terms should be read herein so as to include any type of packaging which has more than a flat shape for enclosure of individual medication dosages for easy, push out usage.

As these various forms of packaging evolved, some by mere design were difficult to open and others were intentionally made more difficult to open in order to prevent or discourage small children from easily pushing pills out of the blisterpacks. These packs sometimes became very difficult for the average person to open and even discouraged the purchase of over-the-counter medications packaged in this manner. Further, even those that were relatively easy for the average adult to open, were difficult for handicapped, senior citizens and people with arthritis and other hand impediments. As a result, some developments in the past decade have led to packaging with dispensing capabilities.

Thus, U.S. Pat. No. 4,384,649 issued to Louis Brodsky and assigned to E. R. Squibb and Sons, Inc. describes a dispensing package which includes a blisterpack and cover with an outer shell wherein the blisterpack has multiple pockets for receiving medications and the outer shell has means for sealing the cover around each pocket of the blisterpack. In one embodiment the outer shell has a rim which includes studs which align with the blisterpack which includes cut-outs so that when it is closed, it affords easier removal of individual medication by the user.

U.S. Pat. No. 4,778,054, issued to Robert E. Newell and Robert A. Fitzsimmons and assigned to Glaxo Group Limited, describes a package for administering medicine to patients which includes a circular carrier disk which has a puncture means for removing individual medication dosages from circular blisterpacks.

U.S. Pat. No. 5,019,125, issued to Thomas M. Rebne and David Esslinger and assigned to Marion Marrell Dow, inc. describes a dispensing container which includes means for pushing individual pills or groups of pills from a blisterpack within the dispensing container. The method involves removal of individual dosages from the container without removing the blisterpack from the container. While this system relies upon puncturing the blisterpack and pushing the pills out, there is no child resistant aspect to it as shown in the present invention. In other words, a user does not remove a blisterpack and strategically place it within a puncture mechanism as in the present invention in order to remove medication from the blisterpack.

U.S. Pat. No. 5,109,984 issued on May 5, 1992 to Jarome M. Romick, describes a unit dosage medication handling and dispensing system. These devices receive blisterpacks and hold them in place and present open bottoms so that medications may be pushed through the blisterpack bottom and through the openings in the bottom of the device.

Not withstanding the stated prior art, it is believed that the present invention is neither taught nor rendered obvious as the present invention specifically accomplishes the dual purpose of enabling a user to more easily puncture and remove medication from a blisterpack while making it difficult for a child to do so by having a remote puncturing mechanism which requires a blisterpack to be removed from the container and properly inserted and then further requires proper usage of the device itself for puncture of the blisterpack and subsequent removal of the medication.

SUMMARY OF THE INVENTION

The present invention is directed to medication container which includes a package designed to receive a softpack of individually segregated unit dosages of medication and a softpack puncturing medication on a flat surface of the package. The softpack puncturing mechanism has a base segment and a top segment which are hingedly connected to one another. The base segment has an orifice located thereon which is of sufficient size to receive a unit dosage section of a softpack commonly referred to as a "blister" and the top segment which has a protrusion adapted to nest within the orifice of the bottom segment. The protrusion of the top segment has sufficient height so as to puncture a dosage unit section of a softpack medication. When a dosage unit or "blister" is placed within the orifice of the bottom segment and the top segment is hingedly pushed downwardly, the protrusion on the top segment will puncture the foil or flat element of the blisterpack. Preferably the puncture mechanism has toothed edges on this protrusion to enhance puncturing. Also, in preferred embodiments, the puncturing mechanism is located on a corner of a package of rectangular configurations whereby the corner locations provide more structural support for the puncturing mechanism.

BRIEF DESCRIPTION OF THE DRAWINGS

The present invention is more fully understood when the specification herein is taken in conjunction with the drawings appended hereto, wherein.

DETAILED DESCRIPTION OF THE INVENTION

The present invention is generally directed to individually segregated dosages of medication contained in softpacks. As mentioned in the Information Disclosure Statement above, softpacks include plasticpacks, paperpacks, metal/foilpacks or packs using a combination of materials which enclose powder, pills, capsules or even liquid capsules or other medication or medicine related dosages in the form of individual units which are segregated from one another. One such softpack is commonly referred to as a blisterpack and softpack as used herein should be taken to mean blisterpacks but not solely limited to blisterpacks. The critical features of softpacks as used herein are that they individually segregate unit dosages of material, and that they are designed so that the user will push the unit dosage out or at least open a unit dosage containment by pushing and therefore bursting or puncturing the softpack backing.

Thus, the present invention is directed to a container such as a medication container which includes a package adapted for insertion and removal of a softpack of individually segregated unit dosages of material such as medication. Such packages are typically formed of plastic, plastic/paper, high quality white cardboard or paperboard or other riged or semi-riged material. Such packages are typically rectangular in shape and are very well known by the artist in the industry. Further, these packages have at least one flat surface and usually all of the surfaces are flat surfaces. Additionally, they usually have flap-type openings with a main flap and sometimes side flaps. Alternatively, they may utilize two long flaps, one folded over the other or heat sealed or otherwise sealed. The only important features of the package which is part of the container of the present invention is that the package is adapted for the insertion and removal of softpacks and that it has at least one flat surface.

In addition to the package utilized as part of the container of the present invention, there is also a softpack puncturing mechanism. This has a base segment and a top segment. The base segment is designed with a cutout orifice which is sized to receive a unit dosage portion of a softpack. Further, the puncturing mechanism top segment includes a protrusion which is of sufficient size to puncture a unit dosage and is properly located so as to nest within the orifice bottom or base segment.

Figure 1:
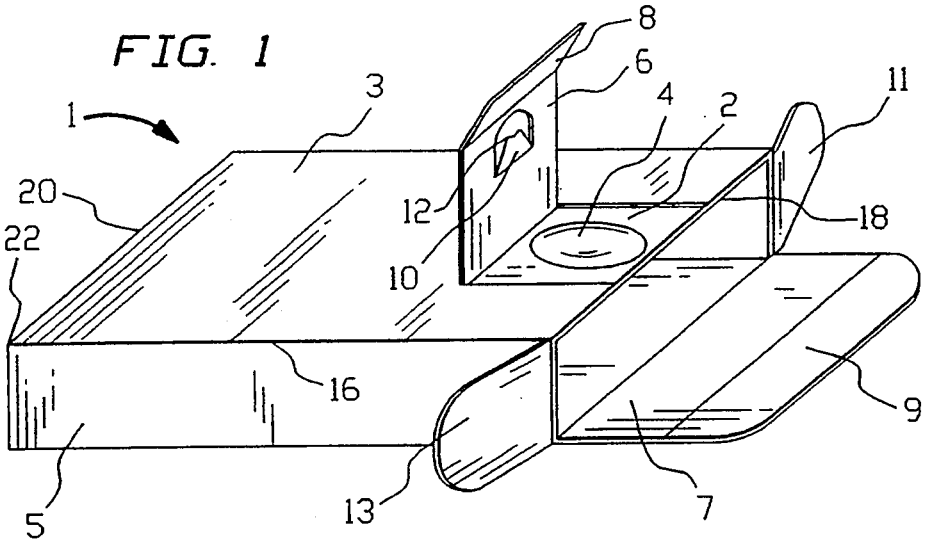
FIG. 1 shows an oblique side view of a present invention container with a puncture mechanism attached to the opening end thereof.

Referring now to FIG. 1 there is shown a medication container which includes a package 1 which has a top portion 3 which is flat as well as side walls such as side wall 5, opening flap 7 with flap insertion 9 and end of flap 11 and 13. Top portion 3 includes a leading edge 18 and a softpack puncturing mechanism which includes base segment 2 and top segment 6 located along leading edge 18 and facing it, as shown.

Figure 2:
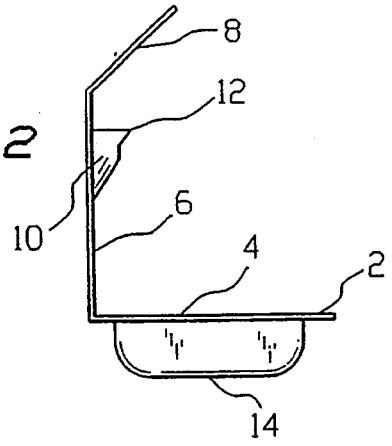
FIG. 2 shows a side view of the puncture mechanism shown as part of the container in FIG. 1.

Referring to both FIGS. 1 and 2, while FIG. 1 shows a side oblique view of the entire medication container of the present invention, FIG. 2 shows a side view of only the puncturing mechanism shown in FIG. 1. In FIG. 2 there is shown base segment 2, with orifice 4 and, in this case, containing an optional receiving basin 14. Top segment 6 has a protrusion 10 with a tooth 12 which is adapted to nest within orifice 4 when top segment 6 is closed. Optional flap segment 8 is included to enhance the lifting up of top segment of 6.

Figure 3:
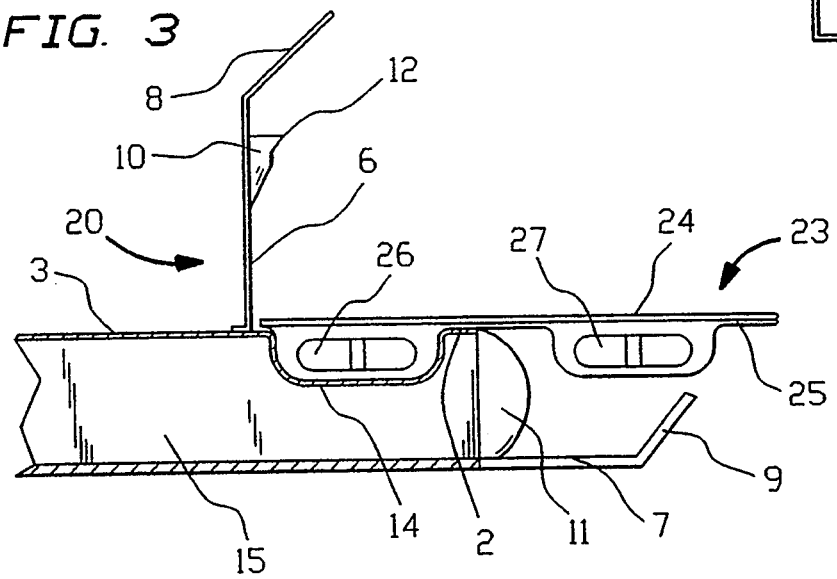
FIGS. 3 and 4 show side cut partial views of the present invention container shown in FIG. 1, but in actual use, with FIG. 3 showing the insertion of a blisterpack and FIG. 4 showing the puncturing of the back side of the blisterpack unit dosage.
Figure 4:
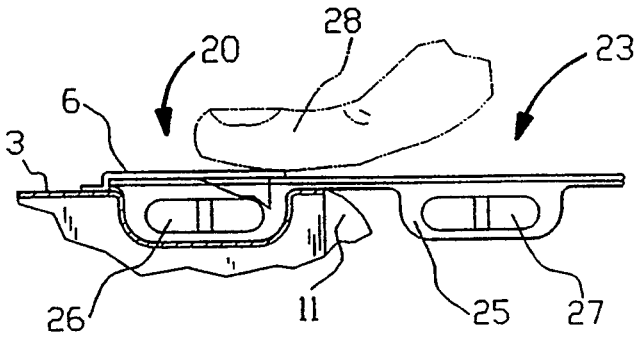

Referring to FIGS. 3 and 4, there is shown in both Figures a partial side view of package 1 as well as the cut side view of the puncture mechanism shown generally as 20. With respect to FIGS. 3 and 4, all parts shown in FIGS. 1 and/or 2 which are identical, are identically numbered and need not be repeated. As shown in FIGS. 3 and 4, softpack 23, includes a base 24 which may be cardboard, foil or foil plastic combination and a plastic blister layer 25. Blister layer 25 has individual dosage units 26 and 27 segregated from one another and this is typical of capsule cold medicine softpacks and the like. Softpack 23 is positioned so that individual dosage units 26 nests within orifice 4 and basin 14 of bottom of base segment 2 of puncture mechanism 20. As shown in FIG. 4, top segment 6 is pushed downwardly while being hinged as mentioned, so that protrusion 10 with tooth 12 punctures the back of which dosage unit 26 is located. FIG. 4 shows thumb 28 completely depressing top segment 6 and shows the actual puncturing of softpack 23. Subsequently, flap 8 is grasped and pulled upwardly so as to expose a punctured backside for dosage unit 26 to be easily removed by a user by pushing the dosage unit through the punctured backing 24.

Figure 5:
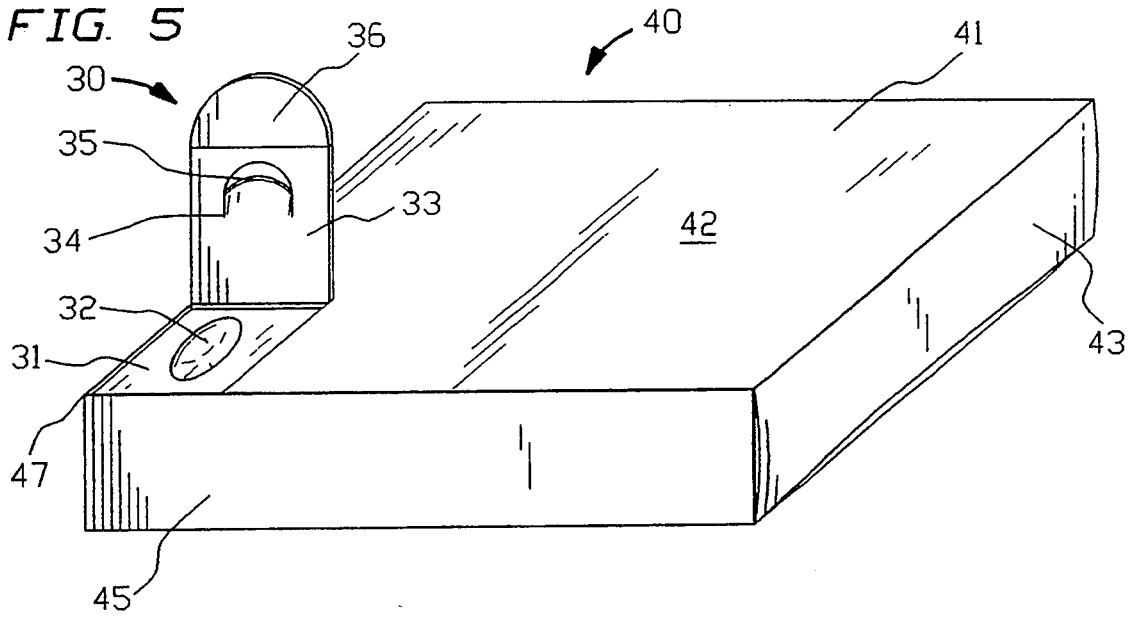
FIG. 5 shows an oblique side view of the present invention container with the puncturing mechanism located in a corner distant from the opening end of the package and located so as to have more structural strength than shown in FIG. 1.

FIG. 5 shows an oblique side view of an alternative present invention container 40 and this includes package 42 with a top flat surface 41, a front flap 43, a side wall 45 and a corner 47. Puncture mechanism 30 is located at corner 47 and includes a base segment 31 with an orifice 32 (and in this case, no receiving basin).

Figure 6:
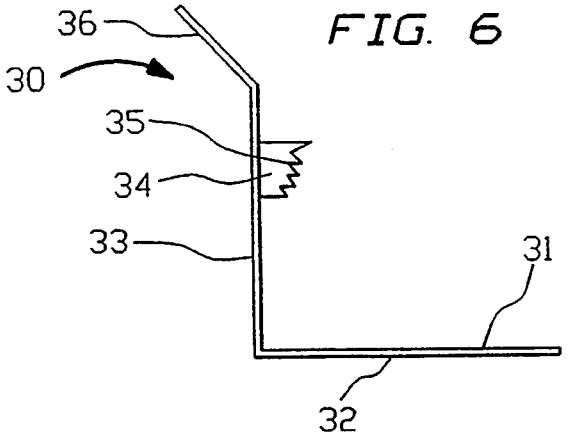
FIG. 6 shows a ! side view of the puncture mechanism of the container shown in FIG. 5; and, FIG. 7 shows an alternative embodiment of the present invention container with a puncture mechanism having an elongated arrangement to allow the puncturing of medication dosage units from a blisterpack at locations other than ends or corners.

As shown in side view FIG. 6, puncture mechanism 30 has no receiving basin and has a protrusion 34 on top segment 33 and includes a plurality of teeth 35, as well as optional end flaps 36. Basically, this is utilized in the same manner as that shown in FIGS. 1 through 4 except that it is located on a corner so that it may be used with a less sturdy package and still receive maximum structural strength due to the support of the corner.

Figure 7:
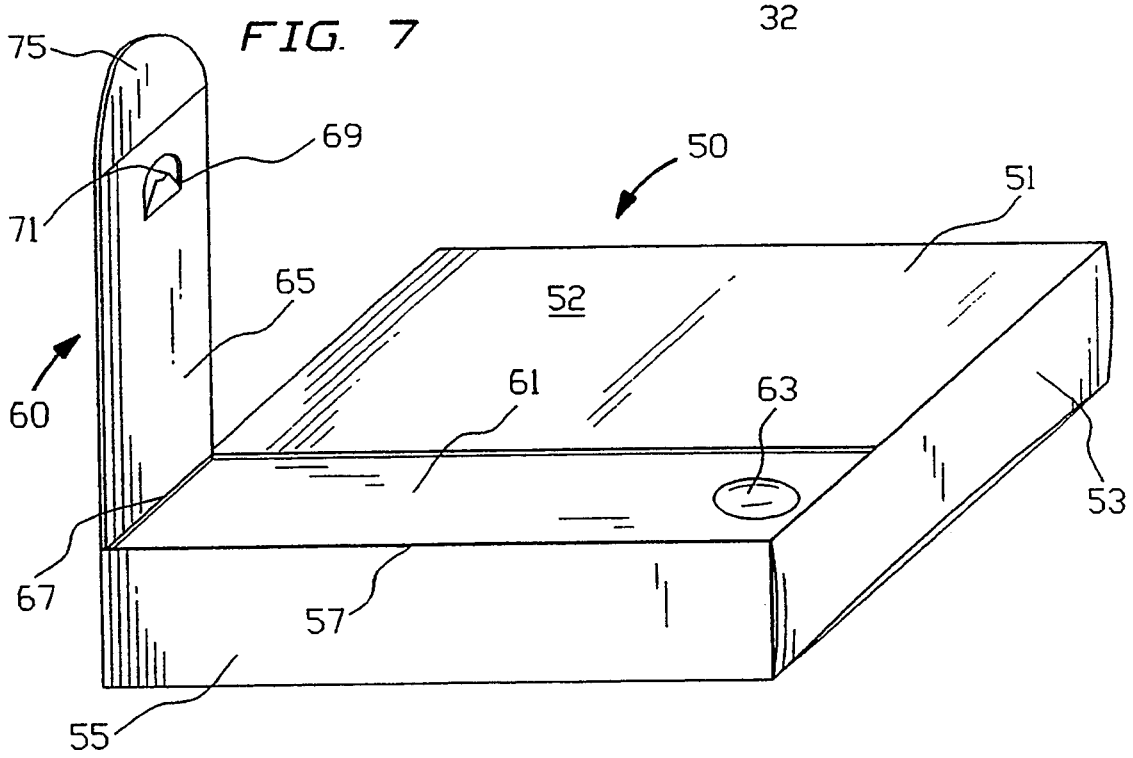

FIG. 7 shows yet another alternative container 50 of the present invention. This includes package 52 with top surface 51, end flap 53, side wall 55 and side edge 57. Puncturing mechanism 60 includes a base segment 61, orifice 63, top segment 65 and optional end flap 73. Protrusion 69 includes teeth such as tooth 71. Top segment 65 is hingedly connected to base segment 61 at edge 67 as shown. Protrusion 69 is strategically located to nest within orifice 63 so as to puncture a unit dosage of medication. However, in this case, the distance from orifice 63 to hinge 67 is a significant distance and may accommodate multiple dosage units. This enables a user to use the puncture mechanism to open unit dosage sections of a softpack which are not located along the edges as well as those which are located along the edges.

The puncture mechanism of the present invention may be formed by porous rigid foam product with a integral rigid coating, may be formed of rigid plastic materials or may be formed of plastic and paper composites. The protrusion itself may likewise be plastic or metal or some other stiff material. The particular choice of construction of materials is not critical, as long as it is designed to withstand the pressing forces needed to puncture a standard softpack of individual dosage materials.

Obviously, numerous modifications and variations of the present invention are possible in light of the above teachings. It is, therefore, understood that within the scope of appended claims, the invention may be practiced otherwise than as specifically described herein.

What is claimed is:

1. A medication container for a softpack of individually segregate dosage units of medication, which comprises:

(a) a package having a generally rectangular shape, having a flap type opening and having at least one flat surface, said opening being of predetermined size for the insertion and removal of a softpack of individually segregate dosage units of medication, the softpack having a softpack backing disposed adjacent to the individually segregated dosage units;

(b) a softpack puncturing mechanism having a base segment and a top segment, said top segment and said base segment being hingedly connected to one another, said base segment having an orifice located therein which is of a predetermined size to receive a dosage unit section of a softpack, and said top segment having a protrusion thereon protruding at approximately a right angle therewith, said protrusion being of predetermined size and shape to nest within said orifice of said bottom segment, and having a predetermined height and strength, the predetermined height relating to the dimensions of the softpack, the dosage unit, and the softpack backing so as to puncture the softpack backing of a dosage unit section of the softpack and so as to retain space between the protrusions and the dosage unit when said dosage unit section is placed within said orifice of said bottom segment while said top segment is hingedly pushed downwardly, the predetermined strength being greater than the strength of the softpack backing, said puncturing mechanism being attached to said flat surface of said package.

2. The medication container of claim 1 wherein said softpack puncturing mechanism protrusion is a thin arctuated protrusion.

3. The medication container of claim 2 wherein said puncturing mechanism base segment is of a predetermined length so that an edge dosage unit of a dosage unit softpack may be inserted into said puncturing mechanism.

4. The medication container of claim 2 wherein said softpack puncturing mechanism protrusion is a thin arctuated protrusion.

5. The medication container of claim 1 wherein said protrusion is a thin arctuated member having at least one tooth to enhance the puncturing of a unit dosage section of a softpack of medication.

6. The medication container of claim 3 wherein said puncturing mechanism base segment is of a predetermined length so that an edge dosage unit of a dosage unit softpack may be inserted into said puncturing mechanism.

7. The medication container of claim 3 wherein said protrusion is a thin arctuated member having at least one tooth to enhance the puncturing of a dosage unit section of a softpack of medication.

8. The medication container of claim 1 wherein said package is a rectangular package with a flap type opening at one end for insertion and removal of a softpack of individually segregated dosages of medication and said puncturing mechanism is located on a top surface and is biased toward a flap of said package.

9. The medication container of claim 8 wherein said package is a rectangular package with a flap type opening at one end for insertion and removal of a softpack of individually segregated dosages of medication and said puncturing mechanism is located on a top surface and is biased toward a flap of said package.

10. The medication container of claim 1 wherein said puncturing mechanism further includes a third segment located on an opposite end from the hinged end from the top segment of said puncturing mechanism and is adapted to function as a lift up mechanism to enhance the hinging upwardly of the top segment of said puncturing mechanism.

11. The medication container of claim 10 wherein said puncturing mechanism further includes a third segment located on an opposite end from the hinged end from the top segment of said puncturing mechanism and is adapted to function as a lift up mechanism to enhance the hinging upwardly of the top segment of said puncturing mechanism.

12. The medication container of claim 1 wherein said package has a generally rectangular shape with a plurality of corners and said softpack puncturing mechanism is located at one of said corners.

13. The medication container of claim 1 wherein said puncturing mechanism base segment is of a predetermined length so that an edge dosage unit of a dosage unit softpack may be inserted into said puncturing mechanism.

14. The medication container of claim 1 wherein base segment is elongated so as to be at least the length of two dosage units of a softpack of individually segregated unit dosages of medication so as to enable the user to insert non edge dosage units into said puncturing mechanism.

15. The medication container of claim 1 wherein said package and said softpack puncturing mechanism is primarily constructed of material selected from the group of plastic, paper, cardboard, plastic-paper laminates and high quality white cardboard.

16. The medication container of claim 1 wherein said top segment is located substantially coextensive with one flat surface when the top segment is closed such that in combination the package and the softpack puncturing mechanism have a generally rectangular shape.

* * * * *